United States Patent [19]

Thompson

[11] 4,188,129

[45] Feb. 12, 1980

[54] DEVICE FOR OBTAINING LATERAL AND VIBRATIONAL MOVEMENT WITHIN ROTATABLE RECEPTACLES

[76] Inventor: Roy F. Thompson, 1909 W. 6th St., Aberdeen, Wash. 98520

[21] Appl. No.: 890,194

[22] Filed: Mar. 27, 1978

[51] Int. Cl.[2] ..... B24B 31/02; B01F 9/00; B01F 11/00

[52] U.S. Cl. ..... 366/108; 51/164.1; 366/220

[58] Field of Search ..... 366/108, 220, 53, 54, 366/55; 51/163.1, 164 R, 164 A

[56] References Cited

U.S. PATENT DOCUMENTS

| | | | |
|---|---|---|---|
| 715,665 | 12/1902 | Jewell | 366/220 |
| 1,331,739 | 2/1920 | Becker | 51/164 X |
| 1,337,716 | 4/1920 | Maddox | 51/164 UX |
| 1,840,429 | 1/1932 | Beckett | 51/164 |
| 2,443,283 | 6/1948 | Wallace | 366/220 |
| 2,525,663 | 10/1950 | Frye | 51/164 X |
| 3,167,890 | 2/1965 | Smith | 51/164 |
| 3,390,867 | 7/1968 | Riedel et al. | 366/220 |

FOREIGN PATENT DOCUMENTS

| | | | |
|---|---|---|---|
| 713439 | 8/1954 | United Kingdom | 51/164 |

*Primary Examiner*—Stanley N. Gilreath
*Attorney, Agent, or Firm*—Kenneth S. Kessler

[57] ABSTRACT

A method for obtaining vibrational and lateral movement within rotatable receptacles is disclosed. The lateral movement is achieved by the interruption of the simple circular motion of a receptacle by slight projections in the circular path of the receptacles. The interruptions cause the materials within the receptacles to vibrate and move laterally rather than continue in a strict circular path. The interruptions may take the form of studs or projections on the outer circumference of the receptacles being rotated or may take the form of studs or projections located on the means rotating the receptacles. The rotatable receptacles are classically rotated by belts.

3 Claims, 4 Drawing Figures

DEVICE FOR OBTAINING LATERAL AND VIBRATIONAL MOVEMENT WITHIN ROTATABLE RECEPTACLES

BACKGROUND OF THE INVENTION

Rotatable receptacles are used for a wide variety of uses. The tumbling action provided by the rotating receptacles have been used to clean and polish metal ware; for mixing and kneading processes; and also for the grinding and polishing of objects particularly stones. When using the process for the perfection of gems, the process includes a procedure where the stone is brought into a rough polish and then later brought into a precision polish with finer material within the receptacle. Under a tumbling action where the receptacles rotate only circularly, this polishing can take up to three to four weeks of constant tumbling action.

Prior U.S. Patents have addressed themselves to the improvement of tumbling action for the cleaning and polishing of items. In U.S. Pat. 1,840,429 by Beckett, projections or studs were attached to the lining of the rotated barrel, the rotating barrel causing the tumbling action. When, however, an article struck the side of the barrel with a ball situated between the article and the lining, the ball was likely to dent or damage the article. By placing soft projections within the barrel, the ball is able to slide between the pliable studs or projections thereby providing a cushion-like action and preventing damage by the striking of the article against the steel ball compacted on the side wall.

In U.S. Pat. No. 3,390,867 by Riedel, et al, a machine with a yieldable wall is disclosed. Rollers cause the drum to rotate. However, since the wall is yieldable and since the roller's inner circumference has a diameter less than the diameter of the drum, the yieldable wall is pressed inward. Thus, the tumbling material which normally moves in a strict circular path in the rotating drum is displaced towards the interior of the chamber thereby aiding in its agitation ability.

Both the Beckett U.S. Pat. 1,840,429 and the Riedel, et al, U.S. Pat. No. 3,390,867 are concerned with circular tumbling action. The present invention adds lateral movement to the material within the rotating receptacle and also give the material a vibrational aspect. By adding the lateral and vibrational aspect the efficiency of the receptacle is greatly advanced. This means a shortening of the time necessitated in polishing stones, for instance, thereby improving the interest of the user and making the process more economical.

SUMMARY OF THE INVENTION

Rotating receptacles which are used to clean and polish amd mix in knead use a tumbling action to achieve the desired results.

The present invention employs projections in the path of the rotating receptacle in order to add a vibrational and agitational aspect to the tumbling action.

By obtaining a vibrational and agitational aspect to the tumbling action, such procedures such as polishing gems are greatly improved. Adding the vibrational and agitation aspect can reduce the necessary time for polishing gems, as one example by one-third to one-half.

Projections can either be placed on the rotating receptacle or can be placed on the means which drives the rotating receptacle. The primary object of the projections are to interrupt the strict circular rotation of the rotating receptacle thereby inducing a vibratonal or agitatonal aspect to the rotating receptacle.

DETAILED DESCRIPTION OF THE DRAWINGS

A rotating receptacle 10 for the polishing of stones 12 is disclosed. Although in the preferred embodiment, the rotating receptacle 10 houses materials 14 for polishing stones 12 it is to be understood that the receptacle 10 may be used for the agitation and cleaning of many different items. In addition, the receptacle may be used in mixing and kneading processes.

Figure 1:
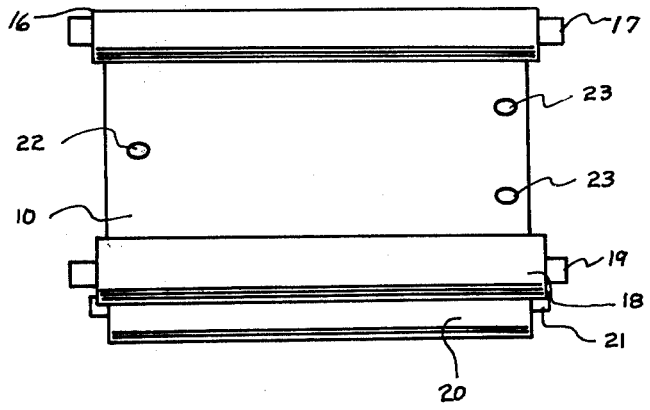
FIG. 1 is a front view of a rotating receptacle with three rotaton bars positoned about the receptacle for rotating the receptacle. Projections are also illustrated on either side of the rotating receptacle in staggered positions.

In FIG. 1 a front view of the rotating receptacle 10 is illustrated with surrounding rotation bars 16, 18 and 20. The rotation bars 16, 18 and 20 cause the receptacle 10 to rotate counter-clockwise. The receptacle 10 will, of course, be as effective if rotated clockwise. Rotation bars 16, 18 and 20 may be powered by various conventional means through shafts 17, 19 and 21. Counter-clockwise rotation causes a tumbling action of the material 14 and stones 12 within the rotating receptacle 10.

Figure 2:
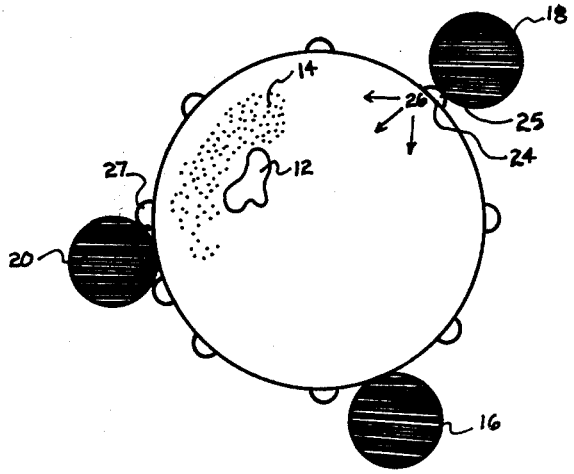
FIG. 2 is a side cut-a-way view of the rotating receptacle illustrating one of the rotation bars passing over a projection.

In order to add a vibrational and lateral force to the tumbling action of the materials 14 and stones 12, projections 22 are attached to the rotating receptacle 10. In FIG. 2 a side view of receptacle 10 cut away along line 2—2 of FIG. 1 is illustrated. As rotation bar 18 approaches and rotates over particular projection 24, the rotating receptacle 10 is forced inwardly towards rotation bars 16 and 20 as illustrated by directional arrows 26. This projects a vibrational and lateral force to the materials 14 and, thus, breaks the circular tumbling action of the receptacle and gives an agitation quality to the material within the receptacle. This agitation quality greatly inhances the ability of the material to achieve the designated process. For instance, in the polishing of stones, exposing a material to a combination agitation-tumbling capability rather than a strict tumbling ability only, can cut the necessary time of the process one-third to one-half.

As the rotation bar 18 passes from the peak of the projection 25 towards the outer circumference of the receptacle 10, the receptacle settles back towards the rotation bar 18 and thereby moves away from rotation bars 16 and 20. This movement is inhanced, as illustrated in FIG. 2, for when the rotation bar 18 contacts the outer circumference of the receptacle 10, rotation bar 20 is approaching and subsequently comes into contact with projection 27. This contact by rotation bar 20 with projection 27 causes the receptacle 10 to be forced inwardly towards the opposing two rotation bars 16 and 18. Given sufficient revolutions per minute of the rotating receptacle 10, the combination of rotation bars and projections, give a strong vibrational and agitational aspect to the materials tumbling within the rotating receptacle 10.

As illustrated in FIG. 1 the projections 22 on one side of the receptacle 10 are staggered from the projection 23 on the other side of the receptacle. Thus, when one portion of a rotation bar passes over the peak of a projection at one end of the receptacle 10, as an example projection 22 in FIG. 1, the opposing portion of the rotation bar is set against the outer portion of receptacle 10. This gives the receptacle a further vibrational force as the receptacle 10 rotates.

In FIG. 2 three rotational bars 16, 18 and 20 are illustrated rotating the receptacle 10. It is to be understood that varying numbers of rotational bars may be used. Two bars are presently being used in the majority of gem tumblers. The use of projections with two bars is adaptable and gives as good a result as rotation by a greater number of bars. Illustrating the use with three rotation bars, however, illustrates the relationship between the diameter of the rotation bars and the projections 22. The inner point of the three or more rotation bars must be of a sufficient circumference in order that when one rotation bar passes over the peak of a projection, the receptacle will not be bound among the remaining rotation bars. Thus, there must be sufficient circumference to allow the vibration of the receptacle.

The addition of an agitation and vibration force to the tumbling action in a rotatable receptacle is particularly advantageous to the polishing of gems. In such a process, a stone 12 is placed within the rotating receptacle along with the material 14 for polishing. In the first step, a fairly course grit is used as a grinding agent to obtain fairly smooth surfaces upon the stone. The second step is replacing the fairly course grit with a finer grit which obtains a still smoother surface. The final step is replacing the fine grit with a polishing agent. Each one of these steps, with the addition of agitational and vibrational forces lowers the time requirement of the tumbling action by one-third to one-half.

Optimum performance for polishing smaller stones is obtained by using a rotatable receptacle which is eight inches in diameter. It is also found that thirty revolutions per minute of the rotatable receptacle is preferred. In reaching the optimum vibrational and agitational force, it is found that three projections on either end of the receptacle, each projection being staggered from one end to the other, is preferred. Finally, the height of the projections depend on the length of the drum. For a drum whose length is up to one foot, however, a height of approximately 3/16" achieves superior results. It is to be understood that for varying uses, different dimensions and speeds will obtain maximum results.

Figure 3:
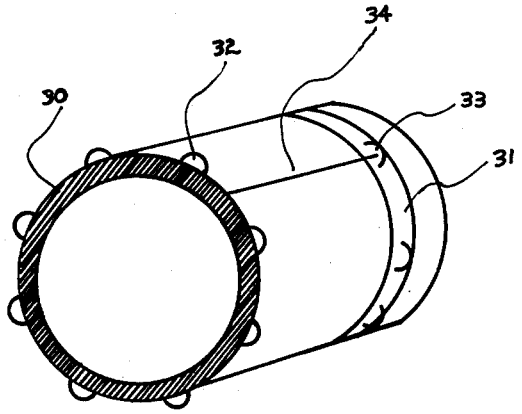
FIG. 3 is a perspective view of a ring with projections being fitted about a conventional rotating receptacle in order to give the rotating receptacle vibrational movement as it turns on its rotating bars. A similar ring has been placed at the opposing end of the receptacle showing the staggered positions of the projections.

In FIG. 3 an expandable belt 30 is illustrated with projections 32 affixed to its outer circumference. The expandable belt may be easily adapted to be affixed about various receptacles. Thus, the user need only fit a belt over a receptacle and place the receptacle within rotation bars, and begin operation. The expandable belts may be made of any conventional elastic material such as rubber. The expandable belt gives a user the capability of fitting his present receptacle with projections.

FIG. 3 further illustrates an additional expandable belt 31 with projections 33 previously affixed to the opposing side of a rotating receptacle 10. Dotted lines 34 accentuate that the projections 32 and 33 are staggered between belts 30 and 31. As explained in conjunction with FIG. 1 this staggered aspect of projections adds another vibrational aspect to the tumbling action.

Figure 4:
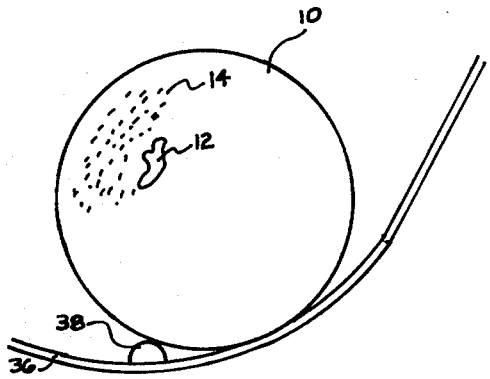
FIG. 4 is a side view of a rotation means with projections about a cylindrical rotating receptacle.

FIG. 4 illustrates the use of projections on the belt 36 which rotates the receptacle. Belt 36 drives receptacle 10 in a counter-clockwise rotation. Attached to belt 36 are projections 38. As the belt 36 drives the receptacle 10, the projections cause a vibration within the receptacle thereby agitating the material 14 and enhancing its grinding and polishing ability.

Belt 36 is one example where projectons may be put upon the driving means. Thus, as an additional example, projections could be placed on the rotation bars previously used in FIG. 2 rather than on the receptacle in order to give the receptacle its vibrational aspect.

Although a particular preferred embodiment of the invention has been disclosed above for illustrative purposes, it will be understood that variations or modifications thereof which lie within the scope of the appended claims are contemplated.

I claim,

1. A vibrational rotatable receptacle comprising:

a cylindrical drum, a series of rotation bars located about the circumference of the drum and being properly positioned to freely support the cylindrical drum and allow movement relative to the rotation bars;

a series of projections attached at either end of the cylinder of the cylindrical drum wherein the projections are staggered such that when a rotation bar passes over a projection at one end of the cylinder, the rotation bar does not pass over a projection at the opposite end of the cylindrical drum.

2. The vibrational rotatable receptacle of claim 1 wherein the series of rotation bars comprises two rotation bars so positioned about the circumference of the cylindrical drum that when one rotation bar passes over a projection the two rotation bars do not restrict the rotation of the drum.

3. The projections of claim 1 wherein the projections comprise small studs, the small studs not being designed to aid in contact with the rotation bars for revolution but designed to provide vibration.

* * * * *